US006609779B2

(12) United States Patent
Davis et al.

(10) Patent No.: US 6,609,779 B2
(45) Date of Patent: Aug. 26, 2003

(54) BELLOWS CAPPING SYSTEM FOR INKJET PRINTHEADS

(75) Inventors: Jeremy A. Davis, Battle Ground, WA (US); Cal K. Stone, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 16 days.

(21) Appl. No.: 10/000,405

(22) Filed: Oct. 31, 2001

(65) Prior Publication Data

US 2003/0081048 A1 May 1, 2003

(51) Int. Cl.[7] ..... B41J 2/165
(52) U.S. Cl. ..... 347/29
(58) Field of Search ..... 347/29, 31, 32, 347/33, 22

(56) References Cited

U.S. PATENT DOCUMENTS

| | | | | |
|---|---|---|---|---|
| 5,146,243 | A | 9/1992 | English et al. | 347/29 |
| 5,448,270 | A | 9/1995 | Osborne | 347/29 |
| 5,712,668 | A | 1/1998 | Osborne et al. | 347/32 |
| 5,867,184 | A | 2/1999 | Quintana | 347/29 |
| 5,936,647 | A | 8/1999 | Rhodes et al. | 347/29 |
| 5,956,053 | A | 9/1999 | Michael | 347/29 |
| 5,980,018 | A | 11/1999 | Taylor et al. | 347/31 |
| 6,132,026 | A | 10/2000 | Taylor et al. | 347/32 |
| 6,135,585 | A | 10/2000 | Johnson et al. | 347/32 |
| 6,196,658 | B1 | 3/2001 | Rhodes et al. | 347/29 |
| 6,209,983 | B1 | 4/2001 | Osborne et al. | 347/32 |
| 6,220,689 | B1 | 4/2001 | Sturgeon | 347/29 |
| 6,312,091 | B1 | 11/2001 | Quintana | 347/29 |
| 2001/0001559 | A1 | 5/2001 | Rhodes et al. | 347/29 |

FOREIGN PATENT DOCUMENTS

| | | |
|---|---|---|
| WO | WO98/18634 | 5/1998 |

OTHER PUBLICATIONS

Hewlett–Packard Company patent application, Ser. No. 09/639,729, filed Aug. 16, 2000, titled "Replaceable Capping System For Inkjet Printheads" patented, pat. No. 6,402, 290 Johnson et al. Jun. 2002 347/32.

*Primary Examiner*—Shih-wen Hsieh

(57) ABSTRACT

A bellows capping system is provided for sealing ink-ejecting nozzles of an inkjet printhead in an inkjet printing mechanism, such as a printer, during periods of printing inactivity. The system includes a support which moves between a sealing position and a rest position. The system also has a cap which extends from the support and terminates in a lip. The lip surrounds the nozzles when the support is in the sealing position. The cap has a wall with first and second leg portions joined together at a knee portion between the support and the lip. When sealing the printhead, the knee bends or buckles so the first and second portions collapse toward each other. Multiple knee portions may join together multiple wall portions in a bellows or accordion arrangement. An inkjet printing mechanism having the bellows capping system and method of using this capping system are also provided.

15 Claims, 3 Drawing Sheets

BELLOWS CAPPING SYSTEM FOR INKJET PRINTHEADS

INTRODUCTION

The present invention relates generally to inkjet printing mechanisms, and more particularly to a bellows capping system for sealing an inkjet printhead during periods of printing inactivity.

Inkjet printing mechanisms use pens which shoot drops of liquid colorant, referred to generally herein as "ink," onto a page. Each pen has a printhead formed with very small nozzles through which the ink drops are fired. To print an image, the printhead is propelled back and forth across the page, shooting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481, both assigned to the present assignee, Hewlett-Packard Company. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is mounted within the printer chassis so the printhead can be moved over the station for maintenance. For storage, or during non-printing periods, the service stations usually include a capping system which hermetically seals the printhead nozzles from contaminants and drying. To facilitate priming, some printers have priming caps that are connected to a pumping unit to draw a vacuum on the printhead. During operation, partial occlusions or clogs in the printhead are periodically cleared by firing a number of drops of ink through each of the nozzles in a clearing or purging process known as "spitting." The waste ink is collected at a spitting reservoir portion of the service station, known as a "spittoon." After spitting, uncapping, or occasionally during printing, most service stations have a flexible wiper, or a more rigid spring-loaded wiper, that wipes the printhead surface to remove ink residue, as well as any paper dust or other debris that has collected on the printhead.

To improve the clarity and contrast of the printed image, recent research has focused on improving the ink itself. To provide quicker, more waterfast printing with darker blacks and more vivid colors, pigment based inks have been developed. These pigment based inks have a higher solids content than the earlier dye-based inks, which results in a higher optical density for the new inks. Both types of ink dry quickly, which allows inkjet printing mechanisms to use plain paper.

During periods of printing inactivity, inkjet printheads are typically capped to prevent them from drying out, with the capping reducing evaporation of the ink components, as well as to protect the printhead from contamination due to environmental factors, such as dust, paper particles and the like. To form a good seal, the cap must conform to the printhead and supply enough force against the printhead to limit air transfer. Traditionally, capping has been accomplished using a compliant elastomer that is pressed against the printhead to create a complete seal.

Traditional inkjet capping solutions have used a vertical beam of elastomer that is pressed against the pen with considerable force, typically greater than 600 grams. Indeed, the forces on some pens may reach as much as 1200 grams or more due to variations in manufacturing tolerances, as well as whether the pen is properly seated against the carriage alignment datums, particularly in multi-pen systems. For instance, in a multi-pen system, one pen may be seated more deeply against the pen alignment datums than the remaining pens, leading to uneven capping forces where the more deeply seated pen receives a higher capping force than the pen which is not seated tightly against the datums. In extreme cases, very high capping forces may ultimately damage the delicate printhead orifice plate through which the ink ejecting nozzles are formed. In other cases having multiple printheads, the cumulative force experienced by one pen may actually exceed a printer's capability to maintain pen alignment and other critical specifications, actually causing the pen to be unseated from the alignment datums. To alleviate these various ills, both pen designers and printer designers look to the service station cap designers to accommodate these manufacturing and installment variations while avoiding damage to the pens.

DRAWING FIGURES

DETAILED DESCRIPTION

Figure 1:
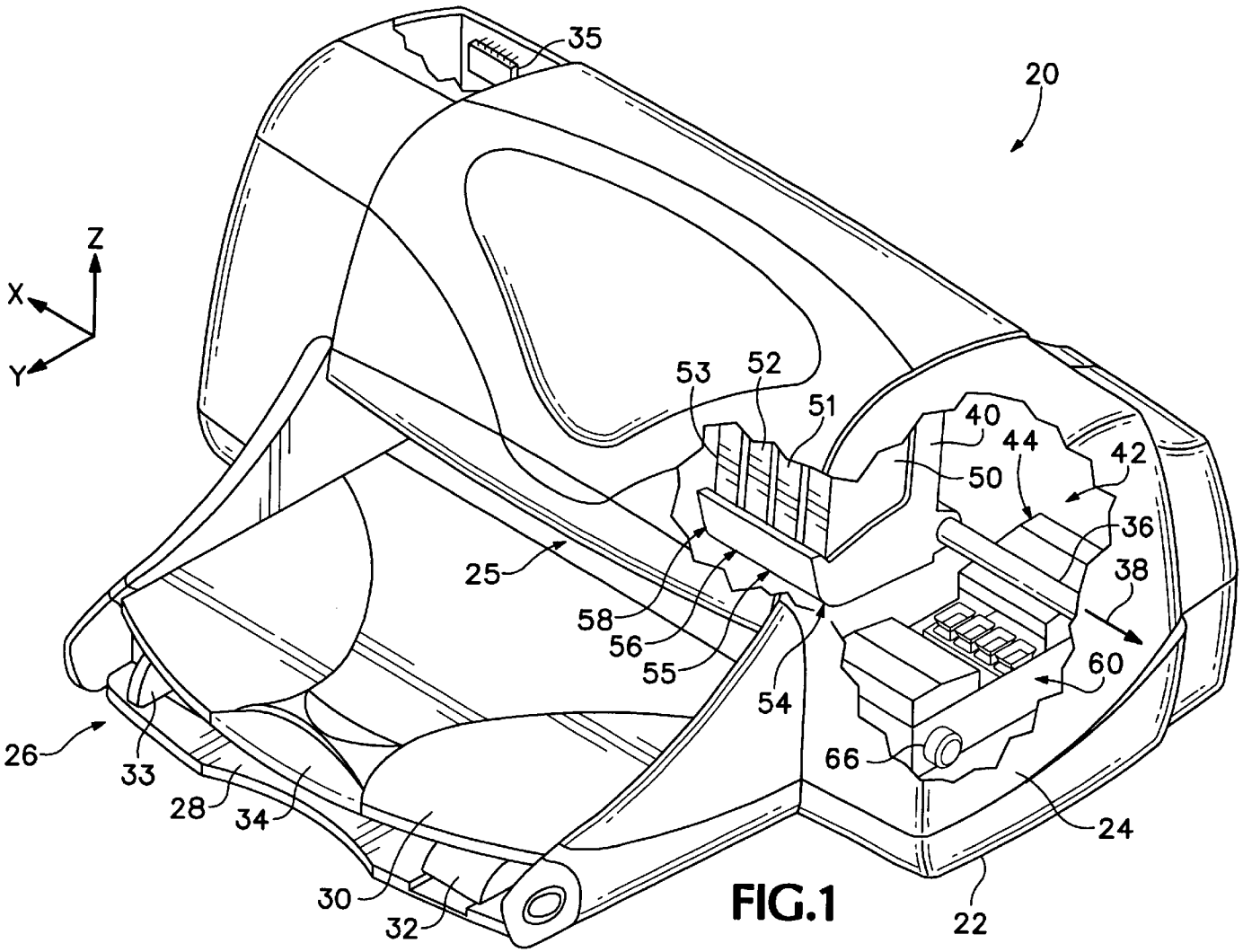
FIG. 1 is a perspective view of one form of an inkjet printing mechanism, here shown as an inkjet printer, having one form of a bellows capping system of the present invention.

FIG. 1 illustrates an embodiment of an inkjet printing mechanism, here shown as an inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few. For convenience the concepts of the present invention are illustrated in the environment of an inkjet printer 20.

While it is apparent that the printer components may vary from model to model, the typical inkjet printer 20 includes a chassis 22 surrounded by a housing or casing enclosure 24, typically of a plastic material. Sheets of print media are fed through a printzone 25 by an adaptive print media handling system 26, constructed in accordance with the present invention. The print media may be any type of suitable sheet material, such as paper, card-stock, transparencies, mylar, and the like, but for convenience, the illustrated embodiment is described using paper as the print medium. The print media handling system 26 has a feed tray 28 for storing sheets of paper before printing. A series of conventional motor-driven paper drive rollers (not shown) may be used to move the print media from tray 28 into the printzone 25 for printing. After printing, the sheet then lands on output tray portion 30. The media handling system 26 may include a series of adjustment mechanisms for accommodating different sizes of print media, including letter, legal, A-4, envelopes, etc., such as a sliding length and width adjustment levers 32 and 33 for the input tray, and a sliding length adjustment lever 34 for the output tray.

The printer 20 also has a printer controller, illustrated schematically as a microprocessor 35, that receives instructions from a host device, typically a computer, such as a personal computer (not shown). Indeed, many of the printer controller functions may be performed by the host computer, by the electronics on board the printer, or by interactions therebetween. As used herein, the term "printer controller 35" encompasses these functions, whether performed by the host computer, the printer, an intermediary device therebetween, or by a combined interaction of such elements. The printer controller 35 may also operate in response to user inputs provided through a key pad (not shown) located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 36 is mounted to the chassis 22 to define a scanning axis 38. The guide rod 36 slideably supports a reciprocating inkjet carriage 40, which travels back and forth across the printzone 25 and into a servicing region 42. Housed within the servicing region 42 is a service station 44, which will be discussed in greater detail below with respect to the present invention. The illustrated carriage 40 carries four inkjet cartridges or pens 50, 51, 52 and 53 over the printzone 25 for printing, and into the servicing region 42 for printhead servicing. Each of the pens 50, 51, 52 and 53 have an inkjet printhead 54, 55, 56 and 58, respectively, which selectively eject droplets of ink in response to firing signals received from the controller 35.

One suitable type of carriage support system is shown in U.S. Pat. No. 5,366,305, assigned to Hewlett-Packard Company, the assignee of the present invention. A conventional carriage propulsion system may be used to drive the carriage 40, including a position feedback system, which communicates carriage position signals to the controller 35. For instance, a carriage drive gear and DC motor assembly may be coupled to drive an endless belt secured in a conventional manner to the pen carriage 40, with the motor operating in response to control signals received from the printer controller 35. To provide carriage positional feedback information to printer controller 35, an optical encoder reader may be mounted to carriage 40 to read an encoder strip extending along the path of carriage travel.

In the printzone 25, the media sheet receives ink from the inkjet cartridges 50–53, such as the black ink cartridge 50, the yellow ink cartridge 51, the magenta ink cartridge 52, and/or the cyan ink cartridge 53. The cartridges 50–53 are also often called "pens" by those in the art. While the color pens 51–53 may contain pigment based inks, for the purposes of illustration, the color pens 51–53 are described as containing dye-based inks. The black ink pen 50 is illustrated herein as containing a pigment-based ink. It is apparent that other types of inks may also be used in pens 50–53, such as thermoplastic, wax or paraffin based inks, as well as hybrid or composite inks having both dye and pigment characteristics. The illustrated pens 50–53 each include reservoirs for storing a supply of ink.

The printheads 54–58 each have an orifice plate with a plurality of nozzles formed therethrough in a manner known to those skilled in the art. The illustrated printheads 54–58 are thermal inkjet printheads, although other types of printheads may be used, such as piezoelectric printheads. Indeed, the printheads 54–58 typically include a substrate layer having a plurality of resistors which are associated with the nozzles. Upon energizing a selected resistor, a bubble of gas is formed to eject a droplet of ink from the nozzle and onto media in the printzone 25. The printhead resistors are selectively energized in response to enabling or firing command control signals, which may be delivered by a conventional multi-conductor strip (not shown) from the controller 35 to the printhead carriage 40, and through conventional interconnects between the carriage and pens 50–53 to the printheads 54–58.

Figure 2:
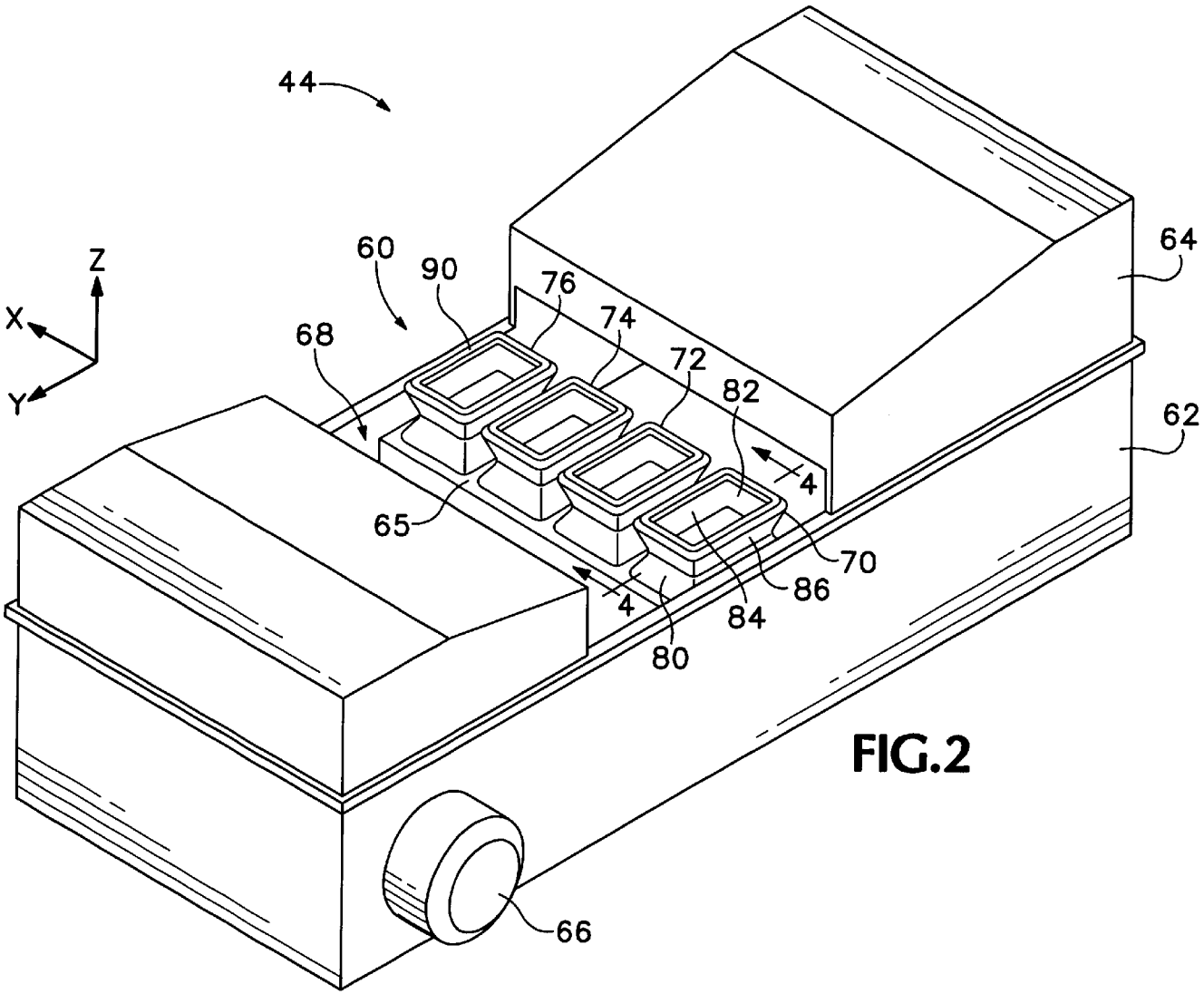
FIG. 2 is a perspective view of one form of a service station of FIG. 1, including the bellows capping system.

FIG. 2 shows the service station 44 as having a bellows capping system 60, constructed in accordance with the present invention. The service station 44 includes a frame having a lower base portion 62 and an upper bonnet portion 64. Sandwiched between the base 62 and bonnet 64 is a sled 65, which is moved toward the forward and rear of the printer along the Y-axis by a motor and gear assembly 66. For instance, the motor 66 may drive the sled 65 using a rack and pinion gear system, such as the system disclosed in U.S. Pat. Nos. 5,980,018 and 6,132,026, currently assigned to the Hewlett-Packard Company. The interior of the service station base 62 may also be used as a spittoon 68 to capture ink which is purged or spit from the printheads 54–58.

The sled 65 supports four bellows or accordion caps 70, 72, 74 and 76, which are used to seal the printheads 54, 55, 56 and 58, respectively. The caps 70–76 may be constructed of a resilient, non-abrasive, elastomeric material, such as nitrile rubber, silicone, ethylene polypropylene diene monomer (EPDM), or other comparable materials known in the art. To accomplish the sealing action, the sled 65 may also move in a vertical or Z-axis direction to elevate the caps 70–76 and bring them into a capping position, as well as to lower the caps to an inactive, rest or passive position, such as shown in FIG. 2. For instance, cap elevation may be accomplished using a four bar linkage system as described in U.S. Pat. Nos. 5,980,018 and 6,132,026 mentioned above, although other gears, solenoids, capping ramps and the like may be used to bring the caps 70–76 into sealing engagement with printheads 54–58.

Figure 3:
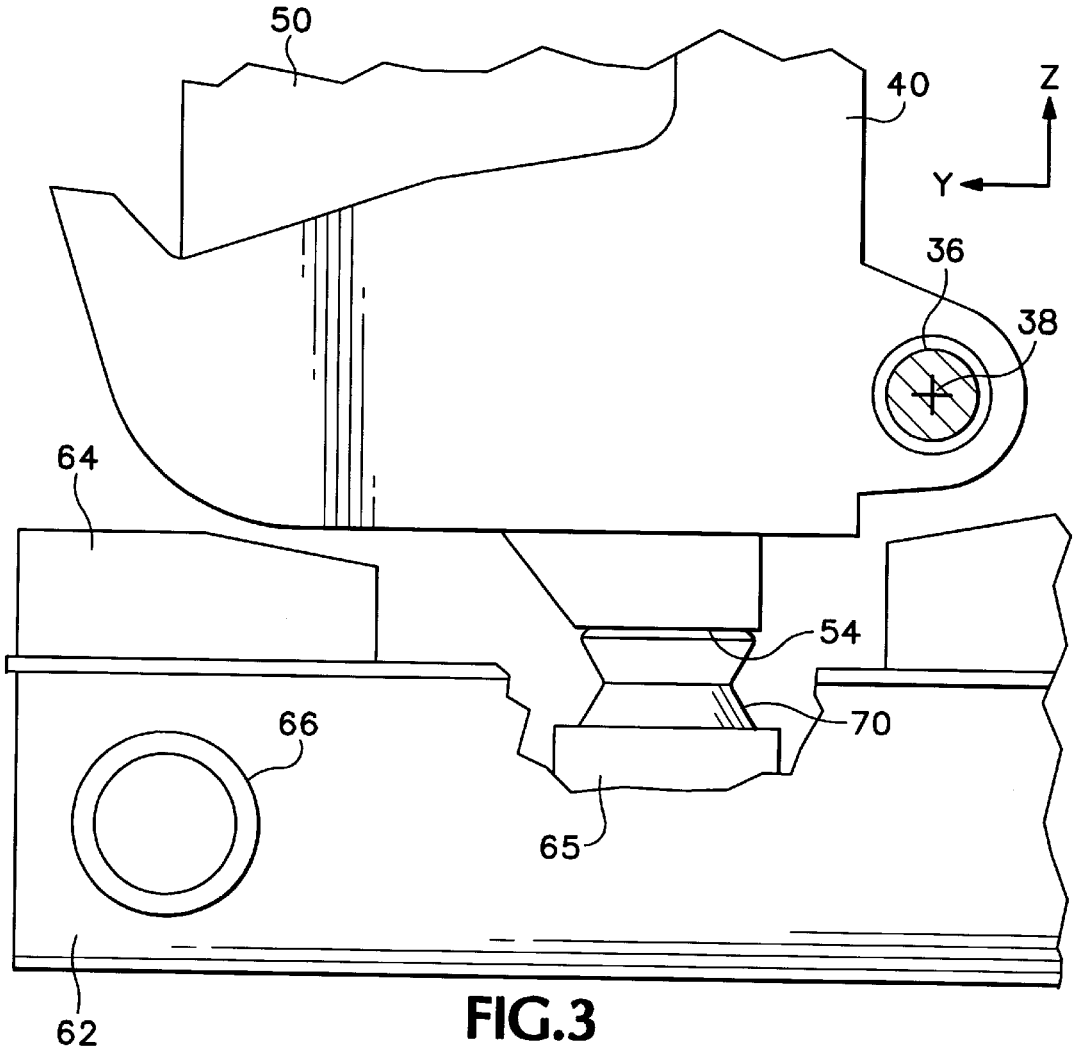
FIG. 3 is an enlarged side elevational view of an inkjet printhead being sealed by the bellows capping system of FIG. 1.

FIG. 3 shows cap 70 in the process of sealing the black printhead 54, with sled 65 elevated into a capping or sealing position. It is apparent that in other inkjet printing implementations, it may be desirable to move the printhead 54 into engagement with cap 70. While the illustrated embodiment shows the sled 65 carrying only caps 70–76, it is apparent that the pallet may be designed to carry other printhead servicing components, such as wipers, solvent applicators, or primers, to name a few. In the lowered inactive position shown in FIG. 2, the sled 65 may be advantageously moved under the bonnet 64 to expose the spittoon 68 to receive ink spit from the printheads 54–58.

As shown in FIG. 2 for cap 70, each of the caps 70–76 have a front wall 80, an opposing rear wall 82, an inboard wall 84 and an opposing outboard wall 86. As used herein, the term "inboard" refers to components facing in the positive X-axis direction, toward printzone 25, while the term "outboard" refers to the opposite direction, that is, in the negative X-axis direction, toward the servicing region 42. The walls 80–86 are joined together at the corners to form a rectangular capping structure which seals against the orifice plates of printheads 54–58, with the rectangular structure being sized to surround the nozzles extending through the orifice plate. While a rectangular shaped cap is the most useful for linear nozzle arrays, it is apparent that other capping geometries may also prove useful in other implementations.

Figure 4:
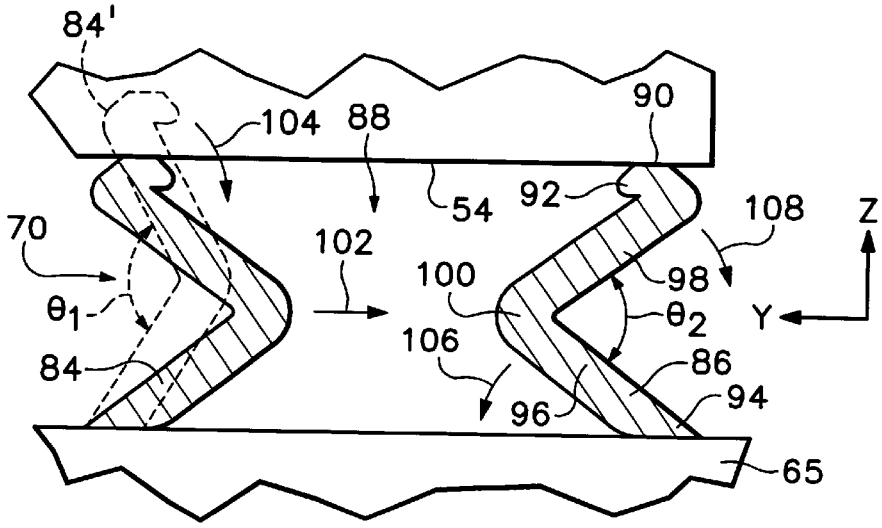
FIG. 4 is an enlarged cross-sectional view taken along lines 4—4 of FIG. 2.

FIG. 4 shows cap 70 sealing the black printhead 54 to form a humid sealing region 88 between printhead 54, cap 70, and the sled 65. While for the purposes of illustration, the caps 70–76 are illustrated as being directly molded to the sled 65, a variety of other designs may be employed along sled 65. For instance, cap venting systems are shown in the Hewlett-Packard Company's following U.S. Pat. Nos. 5,146,243; 5,867,184; 5,614,930; 5,956,053; and 6,220,689, all of which are suitable examples of different manners of venting the cap, as well as attaching the cap to the support sled 65.

In FIG. 4 we see the inboard side wall 84 and the outboard side wall 86 as each having an upper sealing lip 90, which is shown in FIG. 2 as being a unitary lip topping and joining together all of the walls 80–86. Each of the walls 80–86 has a zigzag shape, forming a bellows or accordion type action within the entire cap. The upper portion of each cap wall terminates in an inwardly hooked beak or bill portion 92, while the opposite end of each wall terminates in a base 94 which joins sled 65 in the illustrated embodiment. Each of the walls 80–86 has a lower leg portion 96, adjacent the base, and an upper leg portion 98 adjacent the sealing lip 90 and hooked bill 92, with the upper and lower legs 98, 96 being joined together along an edge or corner, such as by an inwardly bowed knee joint 100.

FIG. 4 illustrates in dashed lines the inboard side wall 84 in an uncapped or rest position 84'. When brought into sealing contact with the printhead 54, the knee joint 100 bends inwardly into the sealing region 88, as indicated by arrow 102, and the upper and lower leg portions 98, 96 are collapsed together along the exterior surfaces of the wall 84. Simultaneously, depending upon the capping force available and required, the inwardly hooked beak 92 may also roll downwardly and inwardly into the sealing region 88, as illustrated by arrow 104. As the knee joint 100 buckles inwardly, the lower leg 96 rotates inwardly in the direction of arrow 106, moving downwardly toward the sled 65, while the upper leg 108 bows outwardly in the direction of arrow 108, also moving downwardly toward the sled 65.

The degree of flexion experienced by knee 100 of any of the walls 80–86 of an individual cap may vary, depending upon the alignment of a plane defined by the printhead orifice plate with respect to a plane defined by the cap sled 65. Thus, the caps 70–76 may accommodate for planar variances between the sled 65 and the orifice plates forming the printheads 54–58. Furthermore, different degrees of bending by knees 100 may be experienced between the various caps 70–76, thereby allowing each cap to compress to a different degree to accommodate different seating depths of pens 50–53 within carriage 40, as well as variations in the elevation of the orifice plates of printheads 54–58 due to various manufacturing tolerances within the pens themselves or within the carriage. Thus, the bellows capping system 60 allows for lower forces to be placed on the printheads 54–58 over a larger range of tolerance variation than was possible using earlier cap designs. The zigzag shape illustrated herein allows the caps 70–76 to be compressed a considerable distance while applying a desirably low force on each of the pens 50–53.

Furthermore, the bellows caps 70–76 provide lower forces against the printheads 54–58 over a larger deflection range of the caps. Many traditional printhead caps have deflection ranges of 0.25 to 0.5 millimeters before they exceed the force capabilities of the system, potentially damaging printheads and/or unseating pens from their datums. Use of the bellows cap design allows caps to be tailored to reach almost any force versus deflection range required in inkjet printing, while still maintaining a good seal on the orifice plates. For instance, the bellows caps 70–76 should operate within a three millimeter range of deflection while maintaining forces of less than 600 grams against the printheads 54–58. One benefit to having such a large deflection range, six to twelve times that experienced with most traditional caps, is the cost savings resulting from reduced part tolerance requirements, allowing both the printer 20 and the pens 50–53 to be more economically constructed.

A reduction in tolerance requirements makes capping multiple printheads with one piece of elastomer more feasible because the bellows capping system 60 deals with the tolerance issue from one end of the cap array to the other end. Although implementation of the bellows capping system 60 is not dependent on multiple caps being supported by a single elastomer, if the caps 70–76 were molded upon a common elastomeric base which is then fit over or upon sled 65, then rather than having four separate elastomeric parts to construct caps 70–76, a single capping unit may be employed. Such a single capping elastomeric part eliminates having separate spring loaded cap bases for each cap, such as the designed disclosed in U.S. Pat. Nos. 5,867,184 and 5,956,053 both currently assigned to the Hewlett-Packard Company. Furthermore, fewer parts also leads to reduced assembly costs, and improved reliability for the overall system.

Thus, by using the bellows or zigzag geometric design, restoration forces inherent in the molded elastomeric caps 70–76 are controlled and manipulated, while also obtaining the greatest range of cap deflection and experiencing a very low range of forces against the printheads 54–58. While other geometric designs may be used, such as by allowing the knees 100 to bend outwardly instead of inwardly, or by having multiple knees, this design may be modified in other ways to provide desired deflection and low capping forces. In the illustrated embodiment, the angled transitions, such as knees 100 and to a lesser extent the hooked bill portions 92, produce a restoring force as they are compressed. This restoring force directly places forces onto the orifice plates of printheads 54–58. These restoring forces are localized in the angled transitions or joints of the bellows, particularly the knee joints 100. This restoring force may be controlled by adjusting a variety of variables, such as the thickness or geometry of the joints, the free angle of the joints at which they are molded, the number of joints in the bellows, as well as the material and material properties of the elastomer.

In the illustrated embodiment, a relaxed or uncompressed angle $\theta_1$ formed between the upper and lower leg portions 96 and 98 at the knee 100 may range from about 90–175° when the system 60 is in the uncapped or rest position. A maximum compressed angle $\theta_2$ may range from about 10–160° when system 60 is in the active capping position. The exact angle $\theta_1$ for the uncompressed state would depend upon various design criteria for a specific implementation, such as desired force levels, desired range of motion, and available design space. In the illustrated embodiment, the uncompressed angle $\theta_1$ is about 110–130°, while the compressed angle $\theta_2$ is about 65–85°.

While the illustrated embodiment has been described with respect to sealing multiple printheads, it is apparent that the same bellows design may be employed for capping individual pens. Furthermore, while the knee joints 100 are shown as having an angular formation joining together two leg segments 96 and 98, it is apparent that in some implementations the joint may be more rounded or arcuate in nature. Similarly, the leg segments 96 and 98 may be of different heights or lengths to provide variations in the capping forces. And finally, the illustrated embodiment of FIGS. 1–4 is shown to illustrate the principles and concepts of the invention as set forth in the claims below, and a variety of modifications and variations may be employed in various implementations while still falling within the scope of the claims below.

We claim:

1. A capping system for sealing around ink-ejecting nozzles of a printhead in an inkjet printing mechanism, comprising:

a support movable between a sealing position and a rest position; and a cap extending from the support and terminating in a lip which surrounds the nozzles when the support is in the sealing position, with the cap having a wall with first and second portions joined together at a knee portion between the support and the lip so the first and second portions collapse toward each other when sealing the printhead.

2. A capping system according to claim 1 wherein the cap has an interior portion adjacent said nozzles when the support is in the sealing position, and said knee portion protrudes into the said interior portion.

3. A capping system according to claim 2 wherein the cap has an exterior portion opposite said interior portion, and the knee portion defines an angle along the exterior portion of the cap between said first and second portions of said wall, with said angle spanning between 90–175 degrees when the support is in the rest position, with said angle decreasing when the cap seals the nozzles.

4. A capping system according to claim 3 wherein said angle decreases to between 10–160 degrees when the cap seals the nozzles.

5. A capping system according to claim 1 wherein the cap has an interior portion adjacent said nozzles when the support is in the sealing position, and said lip has a portion which protrudes into the said interior portion when the support is in the rest position.

6. A capping system according to claim 5 wherein said protruding portion of the lip protrudes further into the interior portion when sealing the nozzles than when the support is in the rest position.

7. A method of sealing around ink-ejecting nozzles of a printhead in an inkjet printing mechanism, comprising:

moving a cap having a lip into contact with the printhead so the lip surrounds the nozzles;

wherein the cap has a wall which terminates in said lip, with the wall having first and second portions joined together at a knee portion; and after contacting the printhead with the lip, collapsing together the first and second portions of the cap wail.

8. A method according to claim 7 wherein the cap wall defines an interior region within which the nozzles reside when sealed by the cap, and said collapsing comprises extending said knee portion into said interior region.

9. A method according to claim 8 wherein the lip has a portion which protrudes into the interior region to a first extent when not in contact with the printhead, wherein the method further includes extending said protruding portion of the lip further into said interior region than said first extent during said collapsing.

10. An inkjet printing mechanism, comprising:

a printhead having ink-ejecting nozzles;

a support movable between a sealing position and a rest position; and a cap extending from the support and terminating in a lip which surrounds the nozzles when the support is in the sealing position, with the cap having a wall with first and second portions joined together at a knee portion between the support and the lip so the first and second portions collapse toward each other when sealing the printhead.

11. An inkjet printing mechanism according to claim 10 wherein the cap has an interior portion adjacent said nozzles when the support is in the sealing position, and said knee portion protrudes into the said interior portion.

12. An inkjet printing mechanism according to claim 11 wherein the cap has an exterior portion opposite said interior portion, and the knee portion defines an angle along the exterior portion of the cap between said first and second portions of said wall, with said angle spanning between 90–175 degrees when the support is in the rest position, with said angle decreasing when the cap seals the nozzles.

13. An inkjet printing mechanism according to claim 12 wherein said angle decreases to between 10–160 degrees when the cap seals the nozzles.

14. An inkjet printing mechanism according to claim 10 wherein the cap has an interior portion adjacent said nozzles when the support is in the sealing position, and said lip has a portion which protrudes into the said interior portion when the support is in the rest position.

15. An inkjet printing mechanism according to claim 14 wherein said protruding portion of the lip protrudes further into the interior portion when sealing the nozzles than when the support is in the rest position.

* * * * *